United States Patent [19]

Kuntzsch

[11] 4,133,598

[45] Jan. 9, 1979

[54] TERMINAL BLOCK

[75] Inventor: Donald W. Kuntzsch, Brookfield, Wis.

[73] Assignee: Allen-Bradley Company, Milwaukee, Wis.

[21] Appl. No.: 851,153

[22] Filed: Nov. 14, 1977

[51] Int. Cl.[2] ..... H01R 9/16

[52] U.S. Cl. ..... 339/198 G

[58] Field of Search ..... 339/198 R, 198 G, 198 GA, 339/198 H, 113 B, 210 R, 210 M

[56] References Cited

U.S. PATENT DOCUMENTS

| | | | |
|---|---|---|---|
| 2,221,710 | 11/1940 | Johnson | 339/198 H |
| 2,258,750 | 10/1941 | Eichwald | 339/198 J |
| 3,135,572 | 6/1964 | Curtis et al. | 339/198 |
| 3,236,975 | 2/1966 | De Smidt et al. | 200/133 |
| 3,275,972 | 9/1966 | Eisert | 339/198 GA |
| 3,293,593 | 12/1966 | Nielsen et al. | 339/198 |
| 3,980,384 | 9/1976 | Lawson | 339/198 GA |

FOREIGN PATENT DOCUMENTS

| | | | |
|---|---|---|---|
| 720450 | 12/1954 | United Kingdom. | |
| 1147975 | 4/1969 | United Kingdom | 339/198 R |

*Primary Examiner*—Neil Abrams
*Attorney, Agent, or Firm*—Quarles & Brady

[57] ABSTRACT

An electrical wire terminal block which is easy to manufacture and assemble includes a molded base, a set of wire terminal units and a molded insert. The wire terminal units are seated on pedestals which are formed on the base in channels between spaced barriers. The insert includes fastening members which cooperate with fastening receptacles on the base to hold the wire terminal units in place.

5 Claims, 5 Drawing Figures

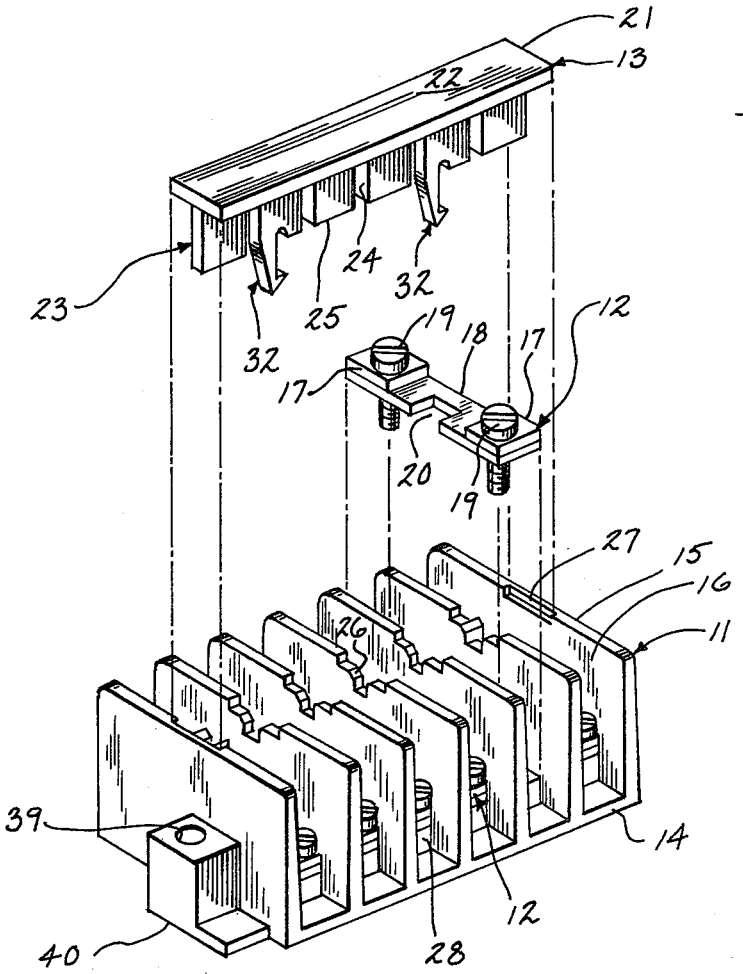
Fig. 1
Fig. 2
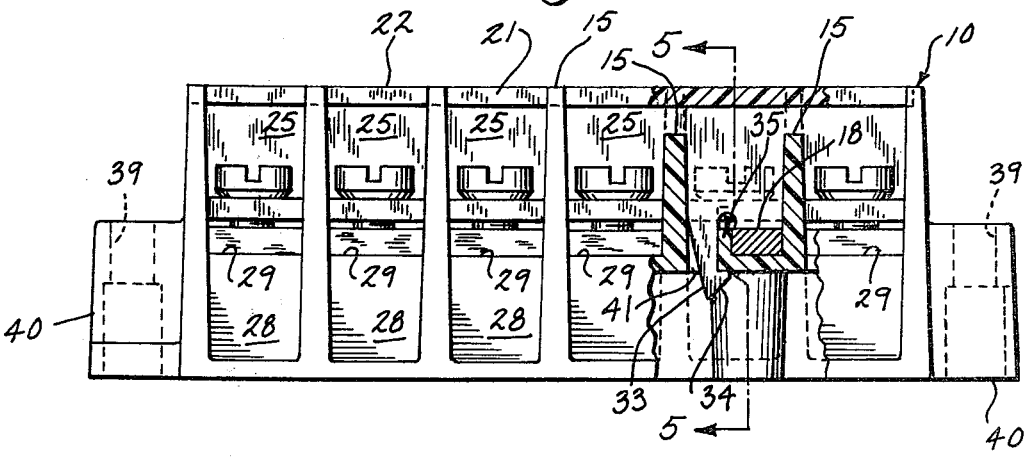

TERMINAL BLOCK

BACKGROUND OF THE INVENTION

The invention relates to a terminal block for connecting two sets of electrical conductors.

One common type of terminal block is formed by mounting individual connector units on a track or channel traversing the bottom of the connector units. This track is severable to yield terminal blocks with different numbers of connector units, as described by W. A. DeSmidt et al in U.S. Pat. No. 3,236,975. This track does not contribute to the function of holding the wire terminals on their individual bases, nor does it provide a longitudinal marker strip, which is a common feature in many electrical connectors. Additional parts and assembly steps are usually required to hold the wire terminals in place and provide a marker strip when individual connector units are used. While track-mounted connectors may be advantageous for some applications, an integral terminal block unit with multiple electrical connectors will provide advantages in manufacturing and assembly, by reducing the number of components and operations necessary to manufacture and assemble the terminal block.

For multiple unit terminal blocks, it is well known to place a market strip longitudinally across a plurality of individual connector units. As seen in E. J. Nielson et al, U.S. Pat. No. 3,293,593 and H. C. Curtis et al, U.S. Pat. No. 3,135,572, the marker strip must be manufactured and assembled separately from pieces which hold the wire terminal units in place. British Patent Specification 720,450, published Dec. 22, 1954 teaches that the marker strip assists in retaining wire terminal units in channels in the terminal block, but the British Patent Specification requires several additional parts to adequately retain the wire terminal units. In Eichwald, U.S. Pat. No. 2,258,750, a flat strip is shown which holds tube-shaped wire terminals to a flat base by means of bolts. Besides being unsuitable for use with screw-type wire terminals, this construction presents some inconvenience in holding all of the parts together during assembly. A simpler fastening means is desirable such as the one shown by Johnson in U.S. Pat. No. 2,221,710. Johnson uses abutments integrally formed with a pair of side walls to hold a flat wire terminal in place; however, the wire terminal must be inserted parallel to the receiving surface with the wire terminal screws partially unscrewed.

Many of the advantages of these prior art constructions can be obtained without the concomitant limitations of the prior art in a new, multiple connector, terminal block which requires fewer parts than most prior art assemblies and which is easier to manufacture and assemble.

SUMMARY OF THE INVENTION

It is a general object of the invention to provide a terminal block which is easy to manufacture and assemble.

The invention relates to a terminal block which includes a molded base including a bottom member, a set of barriers rising from the bottom member and spaced apart to define a plurality of channels, and an integrally formed fastening receptacle, a plurality of wire terminal units, each disposed in a respective one of the channels, and a molded insert fastened to the base to hold the wire terminal units on the base, the insert including a flat strip which is disposed longitudinally across the barriers, a plurality of integrally formed retaining members disposed below the flat strip, and an integrally formed fastening member depending from one of the retaining members and secured in the fastening receptacle of the base.

In a specific embodiment the wire terminal units are disposed on pedestals located in the channels between the barriers. A fastening receptacle is formed in each of two pedestals and left uncovered by the wire terminal unit disposed thereon. The insert is a member having a T-shaped cross section formed by a marker strip, an integrally molded web depending from the marker strip and a pair of integrally molded fastening members, each having a detent to hold it securely in its respective fastening receptacle.

The terminal block of the present invention supports the wire terminal units with a minimum number of parts. By forming fastening devices as parts of the base and the insert, the need for bolts, nuts, adhesives and other separate fastening devices is eliminated.

The integrally formed base is particularly well suited for receiving the wire terminal units and holding them in position until the insert can be fastened to it.

The assembly of the terminal block is facilitated by a fastening mechanism which operates as the insert is being slidably received in the recesses of the base. In addition, guides are formed on the base for aligning the insert and its fastening members with the base and its fastening receptacles during assembly.

Other objects and advantages of the invention will be apparent from the drawings, description and claims that follow.

BRIEF DESCRIPTION OF THE DRAWINGS

FIG. 1 is an exploded perspective view of the terminal block of the invention;

FIG. 2 is a side elevation view of the terminal block of FIG. 1 when assembled, with parts cut away to show the fasteners;

DESCRIPTION OF THE PREFERRED EMBODIMENT

Figure 3:
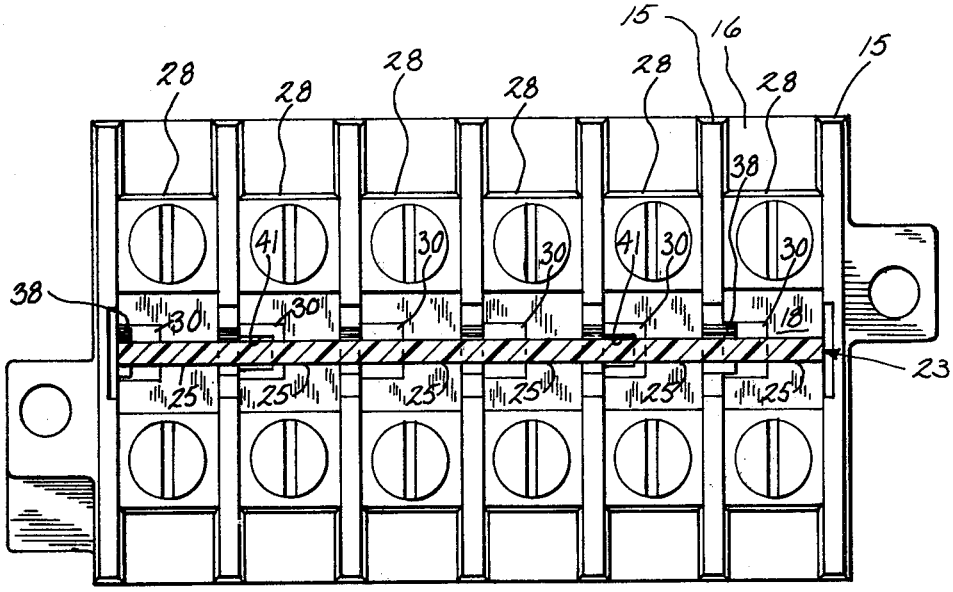
FIG. 3 is a top plan view of the terminal block of FIG. 2 with the marker strip removed.

As shown in FIG. 1, the terminal block 10 includes a base 11 of thermoplastic molded material, a plurality of wire terminal units 12, and an insert 13 of the same material as the base 11. The insert 13 is fastened to the base 11 to hold the wire terminal units 12 in position.

The base 11 includes a bottom planar member 14 and a set of upright walls or barriers 15 rising from the bottom member 14. The barriers 15 are substantially parallel to each other, are substantially perpendicular to the bottom planar member 14, and are spaced apart to define a plurality of channels 16. As shown in FIG. 1, there are seven barriers 15 defining six channels 16, but it should be apparent that the invention is not limited to the number of barriers 15 and channels 16 shown.

Referring again to FIG. 1, the wire terminal units 12 each have a pair of clamping members 17 which cooperate with opposite end portions of a flat connector strap 18 to form a connector between two conductors (not shown). The clamping member 17 and the strap 18 are apertured and aligned to receive a pair of conventional screws which serve as wire terminal screws 19. Each screw 19 threadingly engages one of the clamping members 17 and its respective end portion of the strap 18. Each clamping member 17 closes toward the strap 18 to grip a conductor placed therebetween in response to the rotational advance of the screw 19, and opens to release the conductor in response to the counterrotation of the screw 19. The strap 18 has a rectangular notch 20 located between the clamping members 17.

Still referring to FIG. 1, the insert 13 is an elongated member having a T-shaped cross section. The top section is a flat strip 21 having a top surface 22 on which marks can be made to identify individual wire terminal units 12. Depending from the flat strip 21 is an integrally molded web 23 which includes a plurality of longitudinally spaced notches or gaps 24 that define a plurality of retaining members 25. The interior barriers 15 on the base 11 each have a shallow T-shaped notch 26 which receives the flat strip 21 and the unnotched web portions 23 lying above the gaps 24. The barriers 15 on each end of the base 11 have a rectangular notch 27 for seating the laterally extending end portions of the flat strip 21.

As seen in FIG. 2 the wire terminal units 12 are each disposed on a pedestal 28 formed in a respective one of the channels 16. The insert 13, when fastened to the base 11, completely meshes with the base 11 to hold the wire terminal units 12 in place. The marker strip 21 is disposed longitudinally across the top edges of the barriers 15, the top surface 22 of the strip 21 fitting flush with the top edges of the barriers 15. The notched portions of the top edges of the barriers 15 are received in the gaps 24 between the retaining members 25. As seen in FIG. 3, the web 23 is disposed substantially perpendicular to the barriers 15, the retaining members 25 extending downward to the wire terminal connector straps 18 to divide each channel 16 into two compartments.

Figure 5:
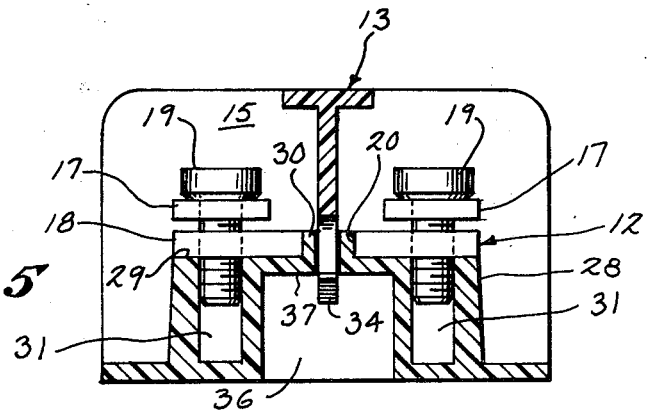
FIG. 5 is a sectional view of the terminal block of FIG. 2 taken along the lines indicated.

The pedestals 28 which support the wire terminal units 12 have a portion of their top surfaces 29 (not shown in FIG. 3) raised to form a locator surface 30. The locator surface 30 is formed approximately midway between the ends of the pedestal 28 and adjacent to one of the barriers 15. The locator surface 30 has a top surface and an edge surface formed on the three sides which are not adjacent to the barrier 15. As seen in FIG. 5, when a wire terminal unit 12 is placed on a pedestal 28, the locator surface 30 is received in the notch 20 of the connector strap 18. The wire terminal screws 19 each extend through a wire clamping member 17 and the strap 18 into one of a pair of positioning holes 31 formed in the pedestal 28, the positioning holes cooperating with the locator surface 30 to form a seat for the wire terminal unit 12.

Figure 4:
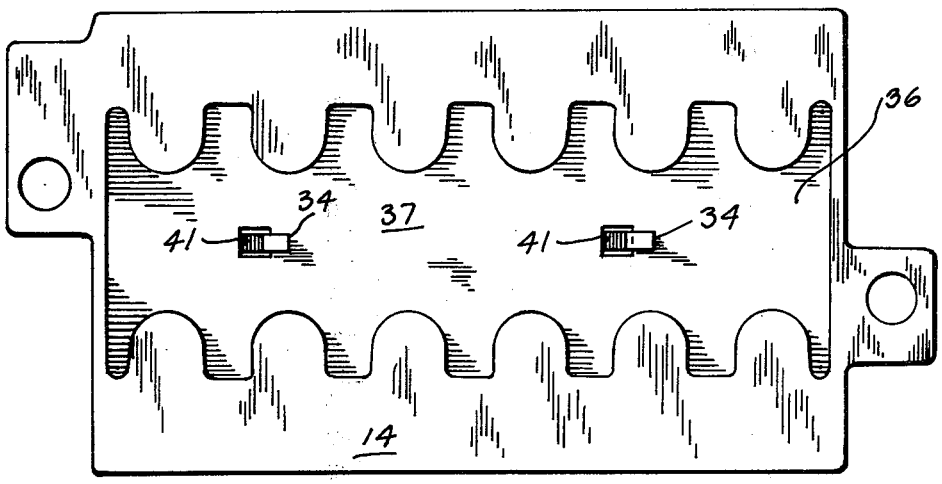
FIG. 4 is a bottom plan view of the terminal block of FIG. 2.

Referring again to FIG. 1, the insert 13 is fastened to the base 11 with a pair of integrally molded, fastening members 32, each formed on the second retaining member 25 from each end of the insert 13. As shown in detail in FIG. 2, each member 32 has a shank 33 which depends from its respective retaining member 25 and a detent 34 formed at the distal end of the shank 33. The fastening members 32 are received in a pair of fastening receptacles 35 which are formed in the pedestal 28 in the second channel 16 from each end of the base 11. The receptacles 35 are formed with an aperture 41 which commences at the locator surface 30, passes through the pedestal 28 and terminates in a cavity 36 as shown best in FIG. 4. The cavity 36 is defined by a surface 37 which is recessed from the bottom member 14.

Each fastening member 32 slides through the aperture 41 of the receptacle 35, the shank 33 yielding until the detent 34 reaches the bottom wall cavity 36 where it engages the recessed surface 37, the shank 33 fitting against the inner surface of the aperture 41 to securely fasten the member 32 and the insert 13 to the base 11.

To align the various parts of the base 11 and the insert 13 during assembly, a pair of guides 38 are disposed in two of the channels 16. As shown in FIG. 3, the guides are grooved members integrally formed on two barriers 15. Each grooved member extends upward from a respective pedestal 28 toward the top edge of the barrier 15 of which it is a part, and the groove is aligned to receive an edge of a retaining member 25 which is disposed substantially parallel to the barrier 15 and the grooved member when the insert is fastened to the base 11.

An assembled terminal block 10 may be mounted on a surface by screws or other fasteners which will fit through holes 39 in a pair of integrally molded mounting blocks 40, one of which is formed on each end of the base 11.

Although the invention has been described with reference to one embodiment, it will be understood by those skilled in the art that the invention is capable of a variety of alternative embodiments. For example, the number and location of the fastening members and fastening receptacles may vary. The receptacles might be formed on the base in other locations than the pedestals. Most of the portions of the insert and the base described herein can be formed on either the insert or the base. Therefore, reference should be made to the following claims for the scope of the invention.

I claim:

1. A terminal block which comprises:

a moled base including a bottom member, a set of barriers rising from the bottom member and spaced apart to define a plurality of channels, a surface which is recessed from the bottom member to form a cavity, a plurality of pedestals each formed in a respective channel above the cavity, one pedestal having an aperture therethrough which communicates with the cavity;

a plurality of wire terminal units, each disposed on a respective pedestal; and a molded insert fastened to the base to hold the wire terminal units in position, the insert including a strip which is disposed longitudinally across the barriers, a plurality of integrally formed retaining members disposed below the strip and located to hold the terminal units in position; and an integrally formed fastening member depending from one of the retaining members and through the pedestal aperture, the fastening member having a portion that is adapted to be secured in the cavity of the base.

2. The terminal block of claim 1, wherein the fastening member has a detent formed on its distal end, the fastening member being slidable into the aperture in the base until the detent reaches the cavity and engages the recessed surface.

3. The terminal block of claim 2, wherein:

the barriers each have a top edge including a notch;

wherein the insert strip is received in the notches in the barriers, the strip having a top surface which fits flush with the top edges of the barriers; and wherein the retaining members are divided by gaps formed therebetween, the retaining members sliding into the channels of the base and the gaps receiving the top edges of the barriers.

4. The terminal block of claim 3, wherein a grooved member is integrally formed on one of the barriers, the grooved member extending upward toward the top edge of the barrier to receive an edge formed on one of the retaining members.

5. The terminal block of claim 4, wherein:

the wire terminal units each include a connector strap having a notch, a pair of clamping members, and a pair of screws, each screw extending through one of the clamping members and the strap to form a wire terminal; and wherein the pedestals include a top sufface for supporting a wire terminal unit, the surface having two positioning holes formed therein and a raised locator surface which together form a seat for a wire terminal unit, the extended end of each screw being received in one of the positioning holes, and the locator surface being received in the notch of the strap.

* * * * *

UNITED STATES PATENT OFFICE

CERTIFICATE OF CORRECTION

Patent No. 4,133,598 Dated January 9, 1979

Inventor(s) Donald W. Kuntzsch

It is certified that error appears in the above-identified patent and that said Letters Patent are hereby corrected as shown below:

Claim 1
Column 4, line 38 "moled" should be -- molded --

Claim 5
Column 6, line 4 "sufface" should be -- surface --

Signed and Sealed this

*Seventeenth* Day of *April 1979*

[SEAL]

*Attest:*

RUTH C. MASON
*Attesting Officer*

DONALD W. BANNER
*Commissioner of Patents and Trademarks*